US009833095B2

(12) United States Patent
Juderman

(10) Patent No.: US 9,833,095 B2
(45) Date of Patent: Dec. 5, 2017

(54) BOOT REMOVER

(71) Applicant: John Juderman, Pineville, LA (US)

(72) Inventor: John Juderman, Pineville, LA (US)

( * ) Notice: Subject to any disclaimer, the term of this patent is extended or adjusted under 35 U.S.C. 154(b) by 0 days.

(21) Appl. No.: 15/012,925

(22) Filed: Feb. 2, 2016

(65) Prior Publication Data

US 2016/0220053 A1 Aug. 4, 2016

Related U.S. Application Data

(60) Provisional application No. 62/110,684, filed on Feb. 2, 2015.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/84; A47G 25/86
USPC ..... D2/641, 642
See application file for complete search history.

(56) References Cited

U.S. PATENT DOCUMENTS 90,076 A * 5/1869 Brown ..... A47G 25/80 223/114
229,118 A * 6/1880 Shechtman et al. ..... G06G 1/04 235/84
3,784,067 A 1/1974 Hicks
D262,240 S * 12/1981 Greifelt ..... D2/642
4,537,337 A 8/1985 Girty
D286,580 S * 11/1986 Stirling ..... D2/642
5,086,959 A * 2/1992 Jerry ..... A47G 25/80 223/111
5,133,488 A 7/1992 Peterson
5,516,015 A 5/1996 Berzins et al.
D420,203 S * 2/2000 Watkins ..... D2/642
6,702,163 B1 3/2004 Hopping

* cited by examiner

*Primary Examiner* — Ismael Izaguirre
(74) *Attorney, Agent, or Firm* — Global Intellectual Property Agency, LLC; Daniel Enea

(57) ABSTRACT

A boot remover for helping a user to more easily remove a boot. The boot remover includes a substantially planar base having a first boot engaging member on one side and a second boot engaging member on an opposing side. A fulcrum is fixedly attached to a lower surface of the base. The first and second boot engaging members are sized differently to allow for removal of different sized boots. Each of the boot engaging members have openings configured to accept the heel of a boot therein. In operation, users place the heel of the boot to be removed in the first boot engaging member and press down on the opposing boot engaging member with their other foot. The first boot engaging member holds the boot in place while the wearer pulls his leg upward to removes their foot from the boot.

8 Claims, 3 Drawing Sheets

BOOT REMOVER

CROSS REFERENCE TO RELATED APPLICATIONS

This application claims the benefit of U.S. Provisional Application No. 62/110,684 filed on Feb. 2, 2015. The above identified patent application is herein incorporated by reference in its entirety to provide continuity of disclosure.

BACKGROUND OF THE INVENTION

The present invention relates to footwear removal devices. More specifically, the present invention relates to footwear removal devices that utilize pressure from one foot on one side of a lever to remove a foot from a boot secured to the opposing side of the lever.

Many individuals utilize functional footwear such as boots for a variety of purposes. A typical characteristic of a boot is that it extends upward from the foot along the lower leg. Boots designed for use in wet climates and other similar types of boots are often bulky and fit snuggly in order to provide a waterproof seal between the wearer's feet and the boot. Due to the height of the boot and the snug fit, it can be very difficult to remove a boot via conventional means.

The removal of boots without assistance often requires considerable strength and dexterity. The wearer is required to bend at the waist to reach the boot for removal, which can be difficult for elderly individuals or for those having a physical impairment. The boot removal process may cause an individual to experience discomfort or pain long after the boot has been removed. Therefore, it is desirable to provide a boot remover that allows users to remove a boot from a standing position without the need for bending at the waist.

SUMMARY OF THE INVENTION

In view of the disadvantages inherent in the known types of footwear removers now present in the prior art, the present invention provides a boot remover wherein the same can be utilized for providing convenience for the user when removing boots and other types of tight-fitting footwear. The present system comprises a substantially planar base having an upper surface, a lower surface, a first side, a second side, a first end and a second end. A preferably cylindrical fulcrum is attached to the lower surface of the base and extends from the first side of the base to the second side of the base. A first boot engaging member comprising a first pair of opposing arms that define a first opening extends from the first end, while a second boot engaging member comprising a second pair of opposing arms that define a second opening extends from the second end. Further, each of the first opening and second opening is configured to accept the heel of a boot therein.

One object of the present invention is to provide a boot remover that allows users to remove a boot from a standing position without the bending at the waist.

Another object of the present invention is to provide a boot remover having different sized boot engaging members in order to provide for the removal of different sized boots.

A further object of the present invention is to provide a boot remover having a high-friction material on an upper surface thereof for supporting a user's foot while the user removes the opposing foot from a boot.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
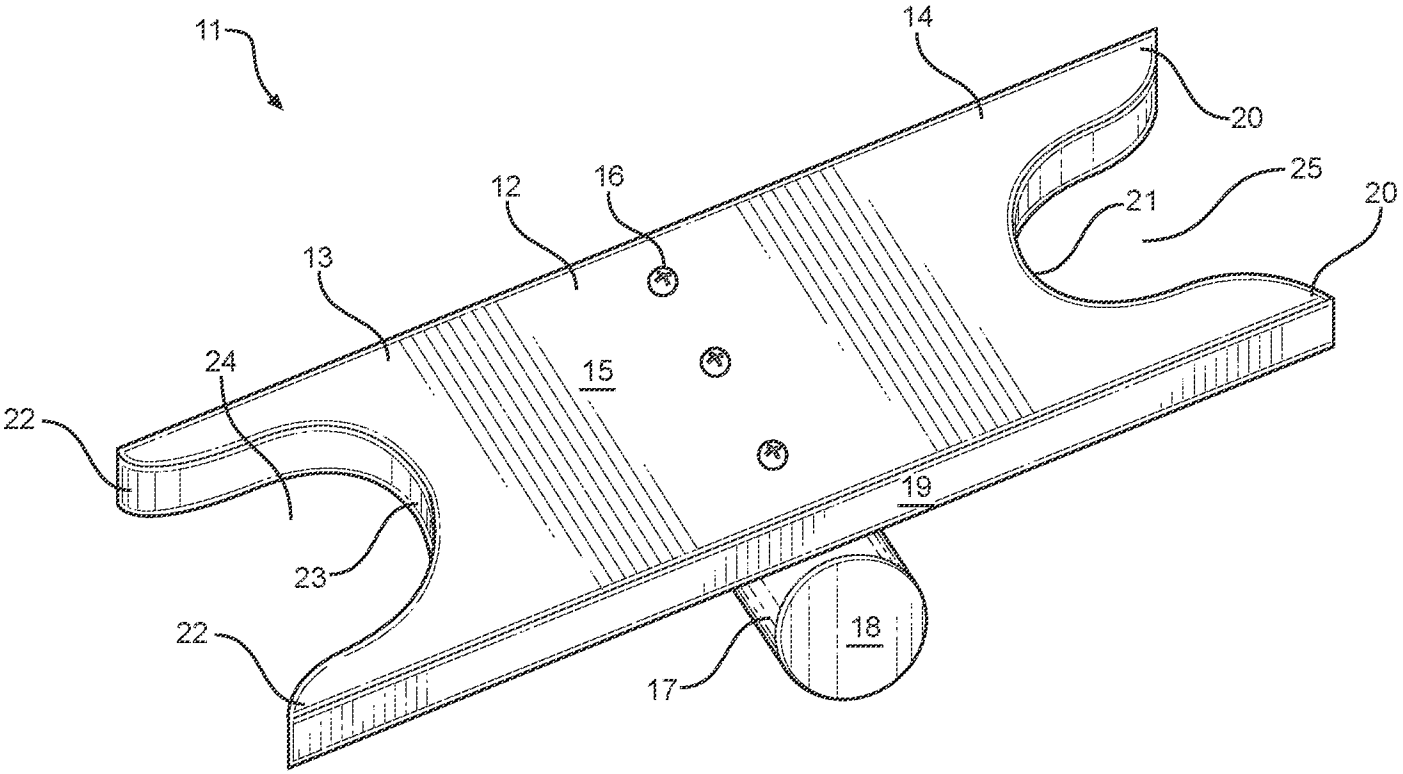
FIG. 1 shows an overhead perspective view of a boot remover according to the present invention.

Reference is made herein to the attached drawings. Like reference numerals are used throughout the drawings to depict like or similar elements of the boot remover. For the purposes of presenting a brief and clear description of the present invention, the preferred embodiment will be discussed as used for boot removal. The figures are intended for representative purposes only and should not be considered to be limiting in any respect.

Referring now to FIG. 1, there is shown an overhead perspective view of a boot remover according to the present invention. The boot remover 11 generally comprises a substantially planar base 12 having a first boot engaging member 13 extending from a first end and a second boot engaging member 14 extending from a second end. The base 12 has an upper surface 15. In one embodiment of the invention, the upper surface 15 comprises a high-friction material having a coefficient of friction greater than one, such as a grip tape. The high-friction material prevents foot slippage during use.

A fulcrum 17 is attached to a lower side of the base 12 and extends between opposing side edges 19 of the base 12. In one embodiment of the invention, the fulcrum 17 has a cylindrical shape. In some embodiments, the fulcrum 17 is integrally formed with the base 12. In an alternate embodiment, the fulcrum 17 is secured to the base 12 via one or more fasteners 16 such as a screw, rivet, or the like. In another alternative embodiment, the fulcrum 17 comprises a half-cylinder having semi-circular cross section, wherein the straight portion of the semi-circle contacts a lower surface of the base 12.

The first boot engaging member 13 comprises a first pair of arms 22 that define a first opening 24. The first opening 24 is configured to accept the heel portion of a boot therein for the purpose of boot removal. The first pair of arms 22 form a U-shape, the inner portion of which contact the sides of a boot and secure it in place within the first opening 24 during removal. Similarly, the second boot engaging member 14 comprises a second pair of arms 20 that define a second opening 25, which is also configured to accept the heel of a boot therein. Each of the openings 24, 25 are further defined by an inner edge 21, 23 that contacts the heel of a boot when the boot is placed within the opening 24, 25. Further, each of the first and second pair of arms form a U-shape that tapers inwardly toward a center portion of the base 12.

In a preferred embodiment, the first opening 24 and the second opening 25 are sized differently in order to accommodate different sized boots. For example, in one embodiment the distance between the first pair of arms 22 is greater than the distance between the second pair of arms 20. This allows a wider boot to be placed within the first boot engaging member 13, while a narrower boot may be removed with the second boot engaging member 14.

Figure 2:
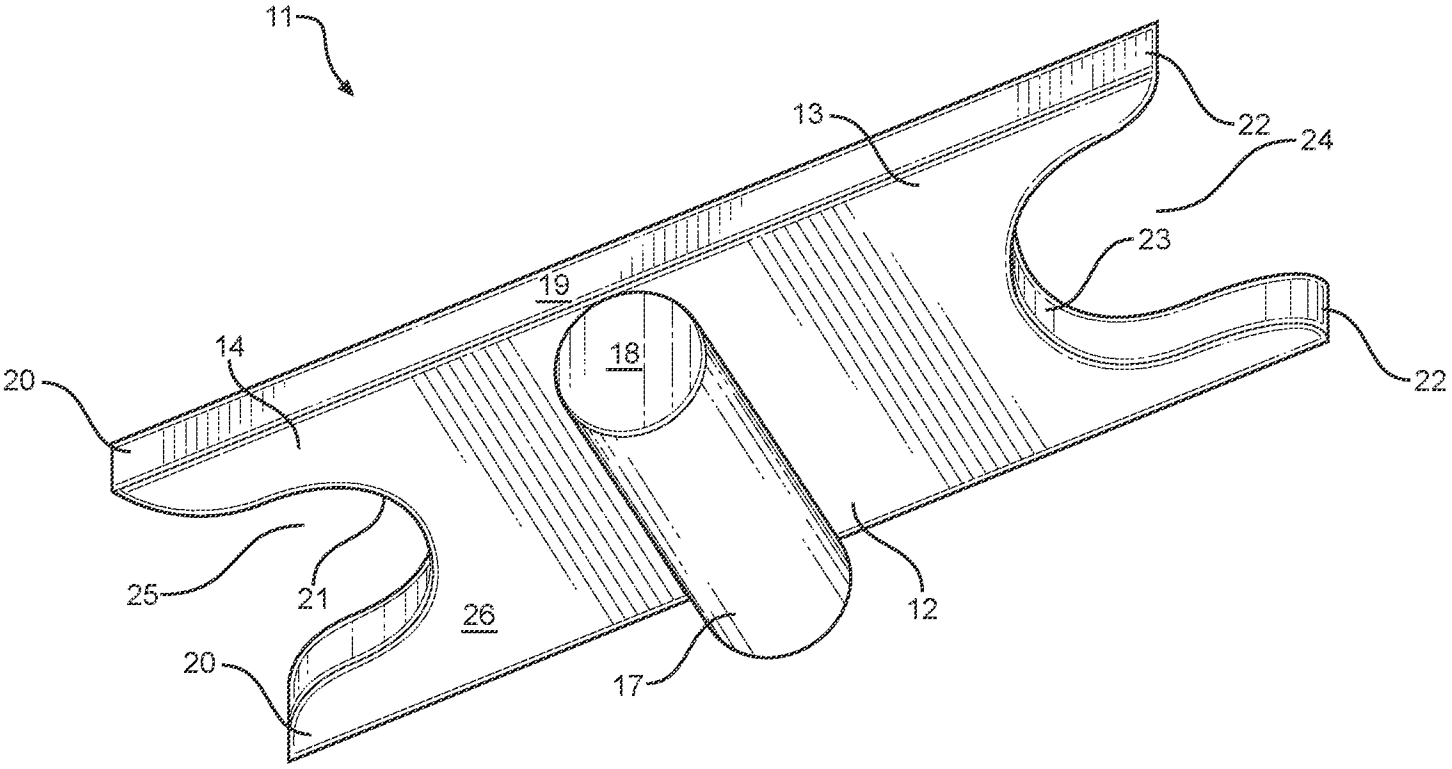
FIG. 2 shows a perspective view of the underside of a boot remover according to the present invention.

Referring now to FIG. 2, a perspective view of the underside of a boot remover according to the present invention is shown. The boot remover 11 is supported on a ground surface during use by the fulcrum 17, which is attached to a lower surface 26 of the boot remover 11. In one embodiment, the fulcrum 17 has opposing planar edges 18 that terminate in the same plane as the opposing side edges 19 of the base 12. This reduces the overall size of the boot remover 11 and allows it to remain compact. Further, the fulcrum 17 is preferably disposed such that the fulcrum 17 bisects the length of the base 12. This allows a user to easily balance on the upper surface of the boot remover 11 while it is supported on the ground by the fulcrum 17, shifting weight between the left and right legs. In this way, the boot remover 11 may also be utilized as a balance improvement tool.

Figure 3:
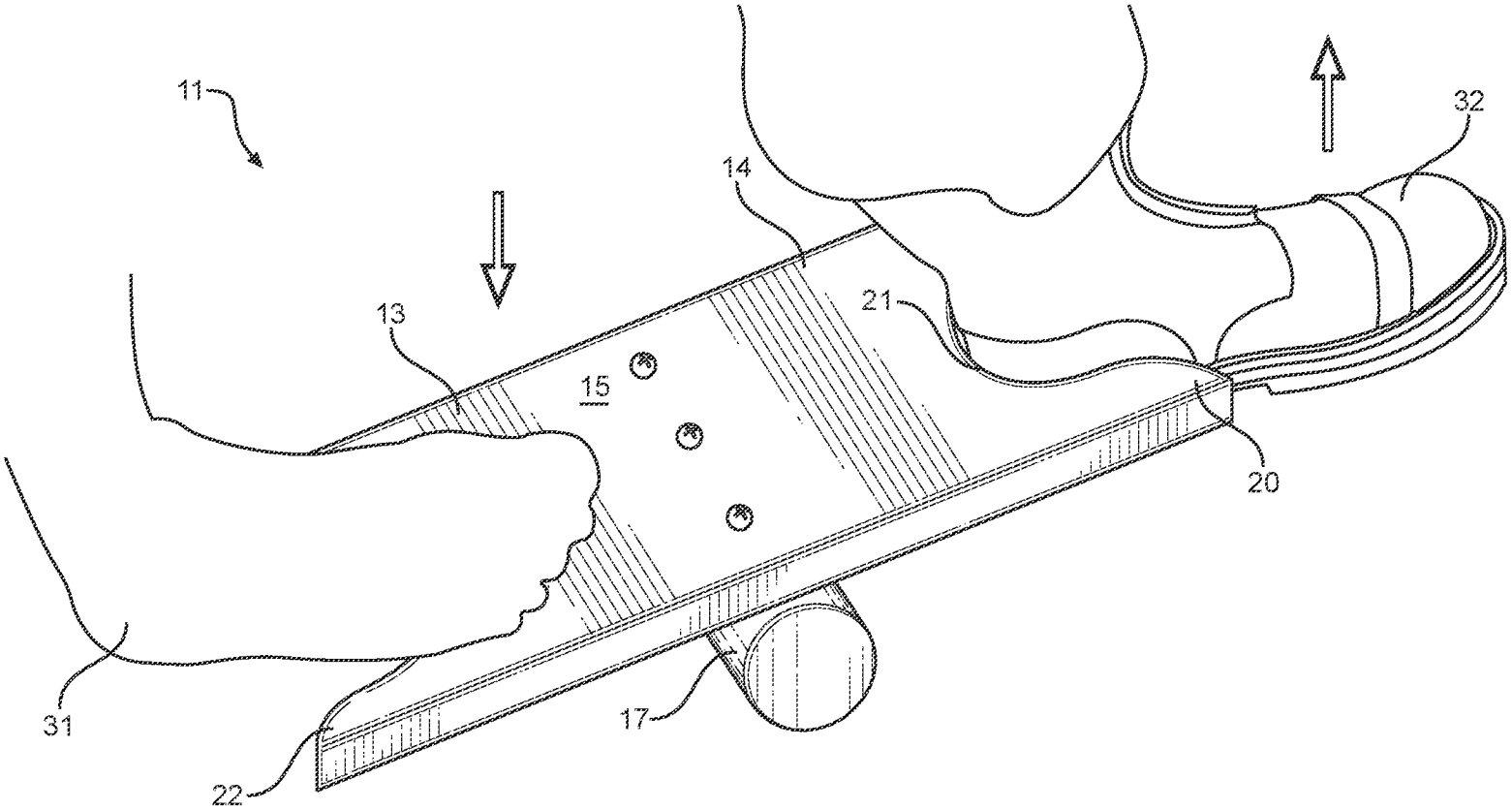
FIG. 3 shows a perspective view of a boot remover according to the present invention being used by an individual to remove a boot.

Referring now to FIG. 3, there is shown a perspective view of a boot remover according to the present invention being used by an individual to remove a boot. In order for a user to remove a boot 32, the user places the heel portion of the worn boot 32 into the either the first boot engaging member 14 or the second boot engaging member 13. The first boot engaging member 14 restrains the boot 32 in place via contact from the arms 20 and the inner edge of the opening 21, which encircle and contact a heel portion of the boot 32. The boot 32 has a wider cross section below the portion restrained by the boot engaging members 13, 14 so that the boot is held in place via a friction fit between the boot and the boot engaging members 13, 14. In the illustrated embodiment, the first boot engaging member 14 is utilized. However, the user may choose to use either the first boot engaging member 13 or the second boot engaging member 14 to remove their boot depending on the size of the boot 32.

After placing the boot within a boot engaging member, the user then places their other foot 31 on the upper surface 15 of the boot remover 11, such that a portion of the foot 31 covers the second boot engaging member 13. In this position, the boot remover 11 is supported on the ground by the cylindrical fulcrum 17 and a lower surface of the second boot engaging member 13. The user then applies downward pressure via their other foot 31 while removing the opposite foot from the boot 32. The first boot engaging member 14 restrains the boot 32 in place while the user pulls there foot upward out of the boot 32, while the downward pressure on the upper surface of the base 15 from the user's other foot 31 prevents the boot remover 11 from moving about during the removal process. In this way, the boot remover 11 may be utilized to provide hands-free removal of a boot 32 from a standing position.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boot remover, comprising:

a substantially planar base having a length, an upper surface, a lower surface, a first end and a second end;

a fulcrum attached to the lower surface of the base, the fulcrum comprising a cylinder, wherein the fulcrum bisects the length of the base;

the base comprising a first side edge and an opposing second side edge, each of the first side edge and the second side edge comprising a uniform length and a uniform width;

the upper surface of the base comprising a high-friction material thereon;

a first boot engaging member disposed on the first end comprising a first pair of opposing arms that define a first opening;

a second boot engaging member disposed on the second end comprising a second pair of opposing arms that define a second opening;

wherein each of the first opening and second opening is configured to accept the heel of a boot therein.

2. The boot remover of claim 1, wherein the fulcrum comprises opposing planar edges that terminate in the same plane as the opposing first and second side edges of the base.

3. The boot remover of claim 2, wherein the fulcrum has a circular cross-section.

4. The boot remover of claim 1, wherein the high-friction material has a coefficient of friction greater than one.

5. The boot remover of claim 1, wherein the fulcrum is integrally formed with the base.

6. The boot remover of claim 1, wherein the fulcrum is secured to the base via one or more fasteners.

7. The boot remover of claim 6, wherein the one or more fasteners comprise one or more screws.

8. The boot remover of claim 1, wherein a distance between the first pair of opposing arms is greater than a distance between the second pair of opposing arms.

* * * * *